United States Patent [19]

Trinkl et al.

[11] 4,423,762

[45] Jan. 3, 1984

[54] METHOD FOR THE PRODUCTION OF A METAL CASTING MOULD HAVING A RISER AND A CAVITY FORMER AND RISER SLEEVE FOR USE THEREIN

[75] Inventors: Gerd Trinkl; Helmut Schopp, both of Borken, Fed. Rep. of Germany

[73] Assignee: Foseco International Limited, England

[21] Appl. No.: 230,956

[22] PCT Filed: Apr. 28, 1980

[86] PCT No.: PCT/GB80/00074

§ 371 Date: Jan. 22, 1981

§ 102(e) Date: Jan. 22, 1981

[87] PCT Pub. No.: WO80/02658

PCT Pub. Date: Dec. 11, 1980

[51] Int. Cl.[3] ..... B22C 9/08

[52] U.S. Cl. ..... 164/37; 164/137; 164/244; 164/360

[58] Field of Search ..... 249/106, 197; 164/37, 164/137, 244, 249, 358–360, 363

[56] References Cited

U.S. PATENT DOCUMENTS

| | | | |
|---|---|---|---|
| 3,815,665 | 6/1974 | Baur | 164/359 |
| 4,131,152 | 12/1978 | Ruddle | 164/359 |
| 4,141,406 | 2/1979 | Wukovich | 164/359 |

FOREIGN PATENT DOCUMENTS

| | | | |
|---|---|---|---|
| 2401508 | 7/1975 | Fed. Rep. of Germany | 164/360 |
| 2907301 | 9/1980 | Fed. Rep. of Germany | 164/360 |
| 1319799 | 8/1970 | United Kingdom . | |
| 530732 | 7/1975 | U.S.S.R. | 164/359 |

*Primary Examiner*—Gus T. Hampilos
*Assistant Examiner*—Richard K. Seidel
*Attorney, Agent, or Firm*—Caesar, Rivise, Bernstein & Cohen, Ltd.

[57] ABSTRACT

A cavity in a body of particulate moulding material has at least one rib-like formation for gripping an object received in the cavity. In the case of a metal casting mould a riser sleeve (1) is inserted into a cavity (9) in the top part of the mould and the cavity (9) is produced by means of a tapered former (5) the exterior of which has a plurality of radially spaced apart recesses (6) extending between the top and towards the bottom of the former and which has a negative taper from bottom to top. The depth of the recesses (6) is such that circles geometrically inscribed inside the base of the recesses (6) have diameters smaller than the corresponding mean outside diameters less three times the standard deviation of the riser sleeves (1) to be used. The recesses (6) form ribs (11) from the moulding sand and the ribs (11) grip the outer surface of the sleeve (1).

7 Claims, 8 Drawing Figures

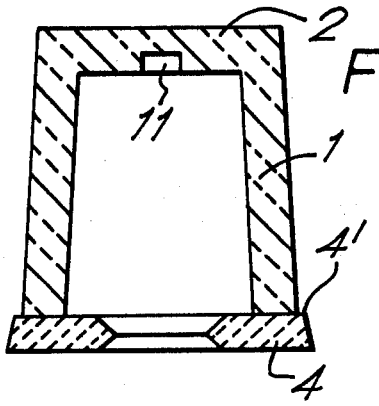
FIG.1.
FIG.2.
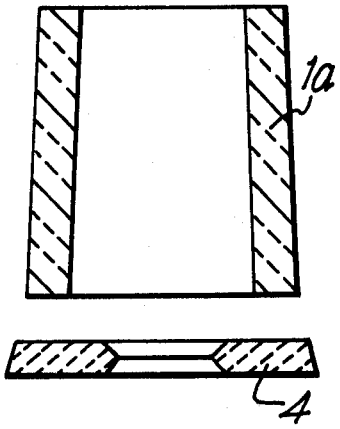
FIG.3.
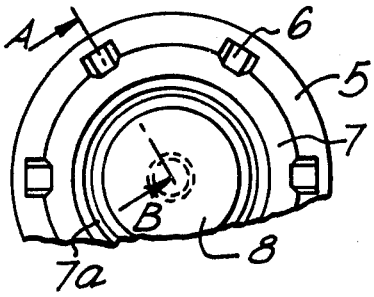
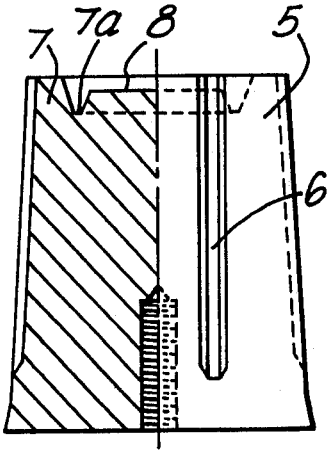
FIG.4.

METHOD FOR THE PRODUCTION OF A METAL CASTING MOULD HAVING A RISER AND A CAVITY FORMER AND RISER SLEEVE FOR USE THEREIN

The present invention is concerned with a method for the production of a metal casting mould having a riser, and a cavity former and riser for use therein.

The use of riser sleeves in metal casting moulds is well known. Up to now, they have been located either by moulding directly on the pattern used to make the mould or subsequently by insertion into the top or cope part of the mould into a cavity formed by a loose pattern piece which has been removed from the top of the mould.

It has also been proposed to insert riser sleeves into open half moulds where the mould has a vertical parting line.

Because of the increasing automation of methods used for the production of casting moulds from moulding material such as sand, there is less access to the pattern plates at the moulding station, especially in the production of repetition castings. As a result, it is no longer possible to apply riser sleeves directly on the pattern plate, nor is it possible to locate a loose piece on the pattern plate to form a cavity into which is later inserted a riser sleeve.

When it is no longer possible to obtain access to the pattern plate an alternative procedure may be possible with automatic moulding plants which are equipped with a cope mould line which is synchronised with a drag line where cores are set into the drag. On the moving cope line, inverted cope moulds are accessible for additional work, so riser sleeves may be inserted in the inverted cope mould.

With riser sleeves which have been used hitherto this is either impossible or only partially successful. Known riser sleeves have a cylindrical or almost cylindrical outer surface for reasons partly concerned with their production technique and partly concerned with their function. Because of dimensional variations inherent in their method of production such riser sleeves cannot be inserted into a preformed cavity with sufficient confidence that they will remain in place securely.

Another group of riser sleeves, especially those which are closed by means of a cap at one end, have a positive taper from their base going up towards the cap, i.e. the outside diameter becomes larger from bottom to top and therefore they cannot be used for the subsequent insertion into the inverted cope mould.

One subject of this invention is the creation of a new method for the production of a metal casting mould made of finely divided moulding material such as moulding sand which makes it possible to insert a riser sleeve readily and so that the sleeve remains securely in a preformed cavity.

According to the invention there is provided a method for the production of a metal casting mould having a riser, in which method a riser sleeve is inserted in a cavity in the mould, the cavity being formed by locating a cavity former in a body of particulate moulding material, compacting the material about the former, and removing the former, characterised in that the former is made oversize relative to the sleeve to be received in the cavity and has one or more recesses therein whereby the cavity is formed with at least one inwardly projecting rib-like formation of moulded material for gripping the sleeve when received therein and the former has a negative taper from bottom to top.

When objects such as riser sleeves are made in quantity to a predetermined nominal size, i.e. height and diameter, in practice the sleeves deviate from that normal size. Such sleeves can still be used provided that they can be inserted in the mould cavities which are to receive them, and that once inserted they will remain in place.

By checking and recording the actual height and diameter of a particular nominal size of sleeve during the course of production it is possible to calculate the standard deviation in height and diameter from the mean values for those parameters for that sleeve.

The invention also includes for carrying out the method a former whose exterior has a plurality of radially spaced apart grooves extending between the top and towards the bottom of the former and whose outside diameters are larger than the corresponding mean outside diameters plus three times the standard deviation of the riser sleeves which are to be used. In this way the outside diameter of the former is larger than the outside diameter of the riser sleeves which are to be inserted in the cavities. Retention of the sleeves in the cavities results from the grip on the outside of the riser sleeve of the sand ribs which are moulded from the recesses in the former. This results in a clamping effect because according to the invention the circles which can be geometrically incribed inside the base of the recesses have diameters which are smaller than the corresponding mean outside diameters less three times the standard deviation of the riser sleeves which are to be used.

According to a preferred feature of the invention the former has at its top end a raised rim which is so dimensioned that the total height of the former thus constituted is greater than the mean height plus three times the standard deviation of the actual riser sleeves which are to be used. Thus there remains after the insertion of the riser sleeve an annular cavity into which any sand, which has been loosened during the insertion of the riser sleeve, may fall, without in any way hindering the desired depth of location of the riser sleeve.

According to another preferred feature of the invention the former has at its top end an annular depression which is so dimensioned that the height of the former up to the base of the annular depression is smaller than the mean height less three times the standard deviation of the actual riser sleeves which are to be used.

By using such a former there is formed after moulding an annular rib of moulding material. This rib is of such depth that it touches even the lowest or shortest inserted sleeve at its top end and when longer riser sleeves are inserted the pad becomes partially compressed. A sealing means is achieved with this arrangement.

A further example of a former according to the invention is characterised in that the annular depression adjoins a surface lying above the level of the annular depression whereby the height of the former up to this surface is greater than the mean height plus three times the standard deviation of the actual riser sleeves which are to be used. By this means, using riser sleeves which are open at the top, an additional riser volume is achieved, while when using a riser sleeve with a closed top an air gap remains between the surface and the top of the cap of the riser sleeve.

The invention also includes a riser sleeve of exothermic, exothermic and heat-insulating or heat-insulating material. According to the invention such a riser sleeve is characterised in that its outer surface exhibits from its base to its top a negative taper having an angle from 2° to 20° with respect to the vertical. Preferably, the inner and outer surface of the tapered riser sleeve are parallel one with another. In another embodiment the sleeve also has a height to diameter ratio (with respect to the lowermost internal diameter) in the range 1:1 to 1.6:1.

According to a further embodiment a riser sleeve according to the invention is characterised in that it has a closed top in which a blind recess is provided which reduces the thickness of the top and which permits the controlled venting of the riser.

Because the cavity is oversized by a predetermined amount, when a riser sleeve is inserted, several air cavities are formed which are separated from each other by the vertical sand ribs and which are connected one with another by the gap at the bottom of the cavity. This has several advantages. Firstly, heat transfer to surrounding moulding material or moulding sand is reduced, and the modulus extension factor of the riser sleeve is increased. Secondly, the atmospheric oxygen contained in the air cavities can lead to a reduction in the necessary quantity of oxidising agents in the sleeve material or by retaining the same amount of oxidising agents the ignition and burning rates of the exothermic sleeves can be increased. Further, in the case of green sand moulds the transfer of moisture to the riser sleeve is reduced. Thereby the ignition and burning characteristics in the case of exothermic sleeves will become more consistent.

Preferably a breaker core is present at the lower end of the riser sleeve and the core has an outside diameter larger than that of the riser sleeve so that the cavity formed by the former can be sealed by the projecting edge of the breaker core. By choosing suitable dimensions for the breaker core the breaker core can be made to seal the cavity formed by the former.

The former of the invention may be made from any suitable material which will retain its shape during mould production.

The invention is illustrated with reference to the drawings in which

FIG. 1 is a cross section through a closed tapered riser sleeve fitted with a breaker core.

FIG. 2 is a section through a tapered open riser sleeve fitted with a breaker core.

FIG. 3 is a top plan view of a former.

FIG. 4 is a section along the line A-B of FIG. 3.

Figure 5:
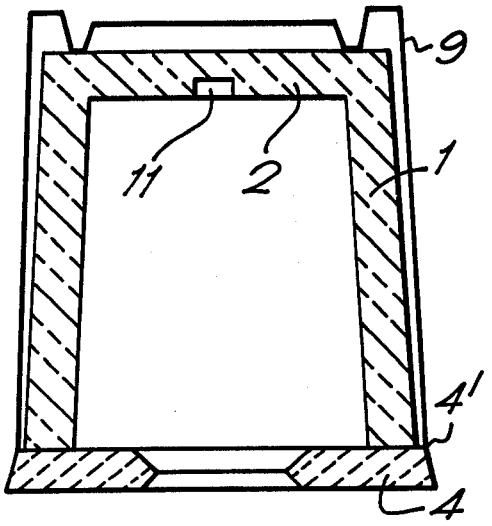
FIG. 5 shows schematically a riser sleeve fitted with a breaker core inserted into a casting mould.

In FIG. 1 a riser sleeve 1 has a closed top 2 and a breaker core 4 fitted by glueing, whose outside diameter is larger than the outside diameter of the riser sleeve 1. As a result the breaker core 4 exhibits with respect to the riser sleeve 1 a projecting rim 4'.

In FIG. 2 a riser sleeve 1*a* is shown which is open at the top and to which a breaker core 4 can be fitted as is indicated in the representation of FIG. 2.

The riser sleeve 1 or 1*a* is made from exothermic, exothermic and heat-insulating or heat-insulating material. The breaker cores 4 are made of refractory material.

As can be seen from FIGS. 1 and 2 the outer surface of the respective riser sleeve has a negative taper from bottom to top having an angle of from 2° to 20° with respect to the vertical. Moreover the inner and outer surfaces of the tapered riser sleeve are parallel one to another.

The ratio of height to diameter of the riser sleeve 1 or 1*a* lies in the range of 1:1 to 1.6:1 with respect to the lowermost inside diameter.

In the example according to FIG. 1 the riser sleeve 1 has a closed top 2 and in this closed top at least one blind recess 11 which reduces the thickness of the top 2 is provided. By means of one or more of such blank recesses a controlled venting of the riser is possible.

In FIGS. 3 and 4 a former 5 is shown whereby the left half of FIG. 4 represents a sectioned view of line A-B in FIG. 3 and the right half of FIG. 4 represents the external view.

The former of FIGS. 3 and 4 has a tapered form corresponding to that of the riser sleeves 1 and 1*a* according to FIGS. 1 and 2, but, the outside diameters of the former 5 are larger than the respective mean outside diameters plus three times the standard deviation of the riser sleeves which are to be used. By this means it is ensured that the former 5 has at any point on its height or length an outside diameter which is larger than the outside diameter of the riser sleeve which after moulding will be inserted or pushed into the cavity formed by the use of the former 5.

The outer surface of the former 5 has distributed around its circumference, several recesses 6 which extend from the top of the former towards the bottom. The recesses 6 form ribs from the moulding sand. The depth of the recesses 6 is chosen such that the circles which can be geometrically inscribed inside the base of the recesses have diameters smaller than the corresponding mean outside diameters less three times the standard deviation of the riser sleeves which are to used. In this way the height of the sand ribs formed in the cavity by the recesses 6 is always such that a riser sleeve inserted into the cavity is gripped by the ribs. The riser sleeve is held fast by the sand ribs with sufficient force to withstand rough treatment likely to separate the sleeve from the cavity.

A raised rim 7 is present on top of the former 5 and is dimensioned so that the total height of the former 5 so formed is larger than the mean height plus three times the standard deviation of the riser sleeves which are to be used. By "mean height" of the riser sleeve the mean height of a particular type of riser sleeve is to be understood. Therefore the former 5 has an added length or is oversize with respect to the length or height of the riser sleeve which is to be inserted. As a result there remains after the insertion of the riser sleeve an empty annular cavity into which sand which is loosened during the insertion of the riser sleeve may fall. This ensures that the riser sleeve is always fixed at the desired depth.

An annular depression 7*a* is present within the rim 7 and is so dimensioned that the height of the former 5 up to the base of the annular depression 7*a* is smaller than the mean height less three times the standard deviation of the riser sleeves 1, 1*a* which are to be used. As a result an annular sand pad is formed in the cavity produced by the former 5 and the height of the pad is sufficient for the pad to contact the top of even the shortest or lowest riser sleeve. With this arrangement a seal is achieved especially in the case of open riser sleeves, or when using capped sleeves which have been vented in the foundry, so that when the sleeves are used and filled with metal, metal cannot flow from above, behind the sleeves.

The annular depression 7a on its inside adjoins a surface 8 which lies above the level of the annular depression the height of the former to this surface 8 is larger than the mean height plus three times the standard deviation of the riser sleeves 1, 1a which are to be used. By "mean height" here again the mean height of a particular type of riser sleeve is to be understood. As a result, after a riser sleeve 1 or 1a has been inserted into the preformed cavity an air gap or a volume of air remains between the top end of the riser sleeve and the surface of the cavity opposite to the sleeve.

FIG. 5 is a schematic representation showing a preformed cavity 9 formed by means of a former 5 according to the invention and in which cavity 9 has been inserted a riser sleeve 1. It is to be understood that the riser sleeve 1 is in close contact on its outer surface with the ribs which are formed on the inner surface of the preformed cavity 9 by means of the recesses 6 in the former. In addition the cap 2 of the riser sleeve 1 is in contact with the annular pad which has been formed by the annular depression 7a in the former 5. Between the outside of the inserted riser sleeve 1 and the wall of the preformed cavity 9 there are several air cavities separated from one another by the vertical ribs but which are all connected one with another by means of the annular air cavity which is formed in the preformed cavity 9 by the rim 7 on the former 5. In addition, an air cavity exists between the cap 2 of the riser sleeve 1 and the opposite end wall of the preformed cavity 9 and is also to be seen in FIG. 5.

In the example according to FIG. 5 a riser sleeve 1 with breaker core 4 is used. Since the diameter of the breaker core 4, already described above, is larger than the lowermost outside diameter of the riser sleeve 1 a seal is formed between the projecting rim 4' of the breaker core 4 and, according to FIG. 5, the lower end of the wall of the preformed cavity 9 when the riser sleeve 1 is insertd into the preformed cavity 9.

Figure 6:
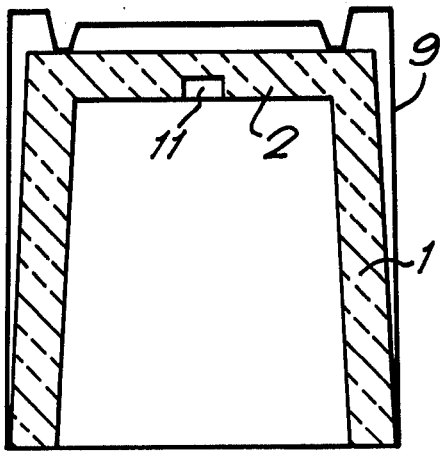
FIG. 6 shows schematically a riser sleeve without a breaker core inserted into a casting mould.

FIG. 6 is an analogous view to FIG. 5 but where a riser sleeve 1, which has no breaker core, is inserted. In order to achieve a seal between the outside of the riser sleeve 1 and the lower end of the wall of the preformed cavity 9 by the use of such a riser sleeve the outside diameter at the lower end of the former 5 is so narrowly shaped that when a riser sleeve 1 is inserted a sealing contact results between the outside of the riser sleeve and the wall of the preformed cavity 9.

Figure 7:
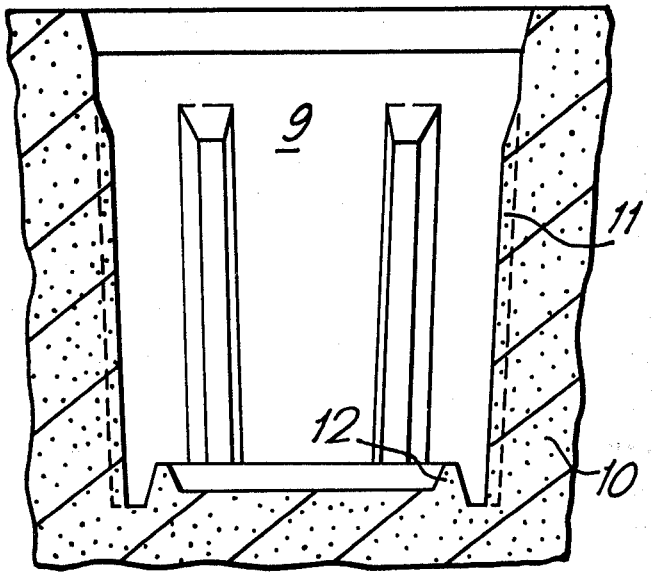
FIG. 7 shows a cavity in a sand mould for the later insertion of a riser sleeve the cavity being formed by a former according to the invention.

FIG. 7 is a schematic view of a section of a sand mould with a preformed cavity 9 in compacted moulding sand 10 and having sand ribs 11 formed by the recesses 6 in the former 5. An annular rib 12 is formed by the rim 7, the cavity 7a and the surface 8 in the shape of the former 5.

Figure 8:
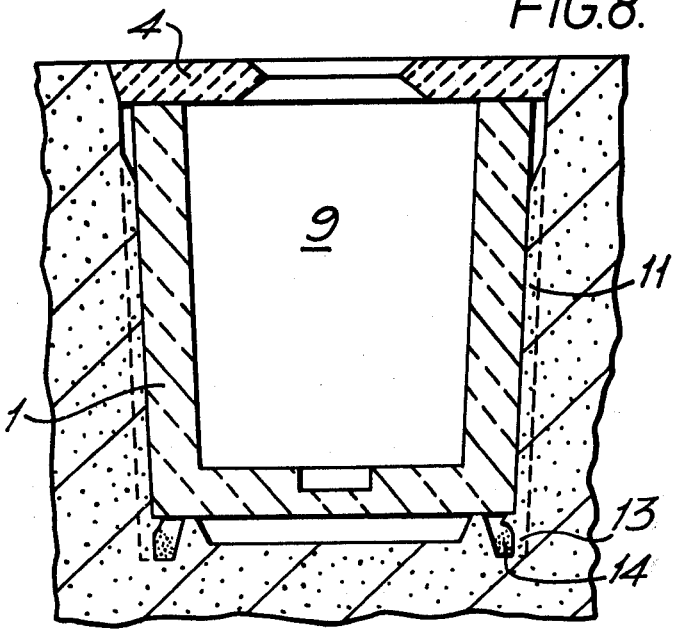
FIG. 8 is analogous to FIG. 7 but shows a riser sleeve fitted with a breaker core inserted into the cavity in the sand mould.

FIG. 8 is an analogous view to FIG. 7 in which a riser sleeve 1 has been inserted into the preformed cavity 9. It may be seen that to a certain extent during insertion of the riser sleeve 1 the sand ribs 11 have been compressed or pinched together so that a secure fit is ensured between the outside of the riser sleeve 1 and the ribs 11. 13 indicates that part of the sand ribs 11 with which the riser sleeve does not come into contact. Sand 14 loosened during the insertion of the riser sleeve 1 has fallen into the described annular cavity where it does no harm.

FIG. 8 shows once again the seal at the wall of the preformed cavity 9 between the breaker core 4 and the compacted moulding sand 10.

As has been said, the riser sleeves may consist of exothermic, exothermic and heat-insulating or heat-insulating material. Examples of such materials are given below:

EXAMPLE 1

Exothermic riser sleeves where made having the following composition by weight:

Silica sand—51.5%
Aluminium grindings—26.0%
Sodium cryolite—5.0%
Clay binder—2.0%
Resin binder—3.5%
Sodium nitrate—12.0%

The materials were mixed with 3–4% by weight water and compacted in core boxes by ramming by hand or using a core shooting machine. The "green" sleeves were stripped from the core boxes and dried at 180° C. The sleeves had a density of 1.3 g/cm$^3$.

EXAMPLE 2

Exothermic and heat-insulating riser sleeves were made having the following composition by weight:

Aluminium powder and grindings—24.0%
Boric acid—1.0%
Sodium cryolite—7.0%
Resin binder—6.9%
Iron oxide—11.0%
Silica sand—17.0%
Alumina—18.5%
Organic fibres—3.6%
Lightweight silica—11.0%

A slurry of the materials was produced in water. Formers for the sleeves were immersed in the slurry and the solid materials in the slurry were sucked on to the formers by means of pressure. The formers were removed and the "green" riser sleeves were dewatered. The sleeves were then stripped from the formers and dried at 180° C. The sleeves had a density had a density of 0.85 g/cm$^3$.

EXAMPLE 3

Heat-insulating riser sleeves were made having the following composition by weight:

Aluminium—5.5%
Alumina—13.0%
Resin binder—9.0%
Aluminium sulphate—1.0%
Colloidal silica sol—6.5%
Aluminium silicate fibres—6.0%
Silica fibres—55.0%
Organic fibres—4.0%

The sleeves were produced using the method described in Example 2.

The sleeves had a density of 0.45 g/cm$^3$.

We claim:

1. A method for the production of a metal casting mould of particulate material, said mould having a mould cavity to produce said metal casting and a riser cavity being in communication with said mould cavity with said riser cavity permitting insertion and gripping of a riser sleeve, said riser sleeve having an opening in communication with said mould cavity, said riser sleeve further having an outside diameter taper such that the outside diameter of the riser sleeve adjacent the mould cavity is greater than the outside diameter of the riser sleeve at the end remote from the mould cavity, said method involving providing a riser cavity former having a taper complementary to said riser sleeve taper, said former having at least one vertically extending recess, locating said cavity former in a body of particulate moulding material, said cavity former having been made oversize relative to the riser sleeve to be received in the cavity, compacting the particulate moulding material about the cavity former and removing said cavity former to form said riser cavity in said moulding material, and wherein said riser cavity has at least one inwardly projecting vertically extending rib-like formation of moulded material for gripping the riser sleeve when received therein.

2. A method according to claim 1 characterized in that the tapered former has a plurality of radially spaced apart recesses extending between the top and towards the bottom of the cavity former and the outside diameters of the tapered former are larger than the corresponding mean outside diameters plus three times the standard deviation of the riser sleeves which are to be used.

3. A method according to claim 2 characterized in the circles which can be geometrically inscribed inside the base of the recesses have diameters smaller than the corresponding mean outside diameters less three times the standard deviation of the riser sleeves which are to be used.

4. A method according to claim 2 characterized in that said cavity former possesses at its top end a raised rim which is so dimensioned that the total height of the cavity former thus constituted is greater than the mean height plus three times the standard deviation of the actual riser sleeves which are to be used.

5. A method according to claim 4 characterized in that it possesses at its top end an annular depression which is so dimensioned that the height of the cavity former up to the base of the annular depression is smaller than the mean height less three times the standard deviation of the actual riser sleeves which are to be used.

6. A method according to claim 5 characterized in that the annular depression adjoins a surface lying above the level of the annular depression whereby the height of the cavity former up to this surface is greater than the mean height plus three times the standard deviation of the actual riser sleeves which are to be used.

7. A method according to claim 2 characterized in that for the use of riser sleeves without breaker cores, the outside diameter of the cavity former towards its lower end is so formed that a sealing contact is achieved between the lower outside diameter of said cavity, said cavity having been formed by the cavity former in which the sleeve is to be inserted.

* * * * *